US005510804A

United States Patent [19]

Talty

[11] Patent Number: 5,510,804

[45] Date of Patent: Apr. 23, 1996

[54] F-SHAPED THREE ELEMENT DIPOLE ANTENNA FOR MOTOR VEHICLES

[75] Inventor: Timothy J. Talty, Trenton, Mich.

[73] Assignee: Ford Motor Company, Dearborn, Mich.

[21] Appl. No.: 316,755

[22] Filed: Oct. 3, 1994

[51] Int. Cl.[6] ..... H01Q 1/32

[52] U.S. Cl. ..... 343/713; 343/802; 343/828

[58] Field of Search ..... 343/713, 802, 343/807, 801, 827, 828, 829, 830; H01Q 1/32

[56] References Cited

U.S. PATENT DOCUMENTS

| | | | |
|---|---|---|---|
| Re. 29,943 | 2/1955 | Finneburgh | 343/802 |
| 3,771,159 | 11/1973 | Kawaguchi et al. | 343/713 |
| 3,805,269 | 4/1974 | Fujimoto et al. | 343/802 |
| 4,038,662 | 7/1977 | Turner | 343/802 |
| 4,868,915 | 9/1989 | Anderson, III et al. | 340/825.31 |
| 4,873,530 | 10/1989 | Takeuchi et al. | 343/711 |
| 4,907,006 | 3/1990 | Nishikawa et al. | 343/700 |
| 4,914,447 | 4/1990 | Ishii et al. | 343/713 |
| 4,942,393 | 7/1990 | Waraksa et al. | 340/825.72 |
| 4,968,984 | 11/1990 | Katoh et al. | 343/713 |
| 5,146,232 | 9/1992 | Nishikawa et al. | 343/713 |
| 5,177,493 | 1/1993 | Kawamura | 343/713 |

*Primary Examiner*—Michael C. Wimer
*Attorney, Agent, or Firm*—Roger L. May; Mark L. Mollon

[57] ABSTRACT

A dipole antenna for use in motor vehicles is provided. The antenna comprises a primary linear element, a secondary element extending from the distal end of the primary element in a generally perpendicular manner and a tertiary element extending from the primary element intermediate to the distal end and a breakpoint in the primary element. The antenna generally represents an "F" shape and is electrically insulated from ground. Further, the antenna may be closely spaced to a ground plane portion of the vehicle to which the receiving device is grounded, thereby providing a directional antenna useful in a passive entry system.

20 Claims, 3 Drawing Sheets

F-SHAPED THREE ELEMENT DIPOLE ANTENNA FOR MOTOR VEHICLES

BACKGROUND OF THE INVENTION

This invention relates to an antenna for motor vehicles, and more specifically to a dipole antenna for motor vehicles.

Antenna technology in motor vehicles become increasing important with the recent rise in mobile communications and convenience items, such as passive entry systems. These systems commonly employ radio waves and, thus require an antenna both for receiving and transmitting. The nature of motor vehicles creates some rather unique problems in antenna design. The antenna must be small and have a low profile, yet be capable of providing a sufficiently wide frequency band and be easily tunable to a desired frequency.

Passive entry systems present additional problems. In passive entry systems an antenna having specific directionality, i.e. separation of one side of the vehicle from the other, is preferred. Further, an antenna having a substantially smooth radiation pattern is preferred. An antenna without a smooth radiation pattern will have significant gaps or voids in the directional pattern from which the antenna may receive signals. In other words, the antenna will not be able to receive a signal generated from the direction corresponding to a gap or void in the radiation pattern and the system will not operate.

U.S. Pat. No. 4,914,447 discloses an antenna for mobile telephone communications. The antenna is mounted on a glass panel of an automobile. The antenna comprises a horizontal element and two vertical elements extending from each end of the horizontal element. The first feeding point is attached to the end of one of the vertical elements. A second feeding point is connected to an earth-line, i.e. ground, such that the antenna in the '447 patent is a monopole antenna.

However, monopole antennas are not completely satisfactory in mobile vehicle applications. As the monopole is grounded to its surroundings, it is more difficult to control impedance or VSWR. It is desirable to tune impedance to match the impedance of a receiver to maximized power transfer. Monopole antennas make such tuning more difficult. Furthermore, monopole antennas do not provide for a substantially smooth radiation pattern as desired in passive entry systems.

U.S. Pat. Nos. 4,907,006, 4,968,984 and 5,146,232 all disclose antennas mounted on vehicles for mobile communications. All three patents disclose cavity-type antennas, which employ sheets of metal bent and fed in different manners. While some embodiments of the '984 patent have an "F" shaped profile, all three patents disclose monopole antennas.

U.S. Pat. Nos. 4,868,915, 4,873,530, and 4,942,393 all disclose passive entry systems. All three systems employ loop or coil type antennas. In the cases of the '915 patent and '393 patent multiple coil antennas are employed. However, loop or coil antennas actually increase the number of voids or nulls in the radiation pattern rather than smoothing it. Furthermore, multiple antennas require additional power to radiate and are more difficult to engineer into the vehicle's structure.

Accordingly, the need remains for an antenna for a motor vehicle which provides a substantially smooth radiation pattern, simplified impedance matching and bandwidth control, for convenient resonant frequency selection for the antenna and broad bandwidth potential.

SUMMARY OF THE INVENTION

This need is met by the present invention whereby an F-shaped dipole antenna having three linear elements is provided. The antenna of the present invention provides a substantially smooth radiation pattern, simplified impedance matching and broader bandwidth potential than those of the prior art.

In accordance with one embodiment of the present invention, a dipole antenna for incorporation into a motor vehicle having three linear elements is provided. The antenna comprises primary, secondary and tertiary linear elements. The primary linear element has a proximal and distal end. The primary element is separated intermediate its distal and proximal ends at a breakpoint. The breakpoint then defines two feedings connections for the antenna. The secondary linear element is connected to the distal end of the primary element and extends generally perpendicular to the primary element. The tertiary linear element is connected to the primary element at some point intermediate the distal end of the primary element and the breakpoint. The tertiary element also extends generally perpendicular to the primary element.

As mentioned, the dipole antenna is designed for incorporation into a motor vehicle. The motor vehicle into which the antenna is installed defines an electrical ground potential. The dipole antenna of the present invention is electrically insulated from the motor vehicle ground potential. To this end, the dipole antenna can be incorporated into a glass portion of the vehicle, such as an opera window.

At least some portion of the motor vehicle is maintained at the motor vehicle ground potential and thereby defines a ground plane. The dipole antenna of the present invention may then be incorporated into such a portion of a motor vehicle and closely spaced to the ground plane. Preferably, the antenna is spaced about ½sth or less of a wavelength from the ground plane.

In an additional embodiment, the ground plane comprises a portion of a side of the motor vehicle. The dipole antenna is then mounted on the portion of a side of the motor vehicle. In this fashion, the ground plane makes the antenna directive from the side of the motor vehicle. That is, the antenna receives radio waves approaching from the side of the motor vehicle on which the antenna is mounted. The antenna may be oriented either with the primary element being horizontal or with the primary element being vertical.

In accordance with a further embodiment of the present invention, a method for making a dipole antenna for a motor vehicle is provided. The method comprises providing a primary linear antenna element having a proximal and a distal end. The primary antenna element is then separated intermediate its distal and proximal ends to define two feeding connections to the dipole antenna. Next, a secondary linear antenna element is connected to the distal end of the primary antenna element to extend generally perpendicular to the primary element. Finally, a tertiary linear antenna element is also connected to the primary element. The tertiary element is connected intermediate to the distal end of the primary element and the two feeding connections to extend generally perpendicular to the primary element.

The method further comprises the step of selecting the combined length of the primary element and the secondary element to select a desired resonant frequency for the dipole antenna. The method also comprises the step of selecting the spacing between the secondary and tertiary elements to smooth nulling of an antenna pattern of the dipole antenna. Further, the method comprises the step of selecting the length of the tertiary antenna to increase the impedance bandwidth of the dipole antenna.

The method of the present invention also includes mounting the antenna over a portion of a motor vehicle defining a ground plane and insulating the antenna from the ground plane to adjust the voltage standing wave ratio of the antenna. The portion of the motor vehicle selected as the ground plane may be a side of the vehicle. In this manner, the antenna becomes directive from the side of the vehicle. Preferably, the rear quarter panel of the motor vehicle is selected as the ground plane.

Accordingly, it is a feature of the present invention to provide a dipole antenna which can be easily impedance matched, provides broad bandwidth and smoother radiation patterns comprising a dipole antenna having three elements; to provide an antenna system for a passive entry system comprising a three element antenna and a receiving device for receiving signals inputted to the antenna; and to provide a method for making a dipole antenna from three linear elements. These, and other features and advantages of the present invention will become apparent from the following detailed description, the accompanying drawings and the appended claims.

DETAILED DESCRIPTION OF THE PREFERRED EMBODIMENTS

The present invention relates to a dipole antenna for motor vehicles. The antenna may be adapted for use with a multitude of receiving systems such as those used for mobile communications, FM radio, AM radio, passive entry systems and the like. The antenna provides excellent directional properties, provides broader bandwidth and smoother radiation patterns than antennas of the prior art, and provides substantially easier impedance matching with a selected receiver.

Figure 1:
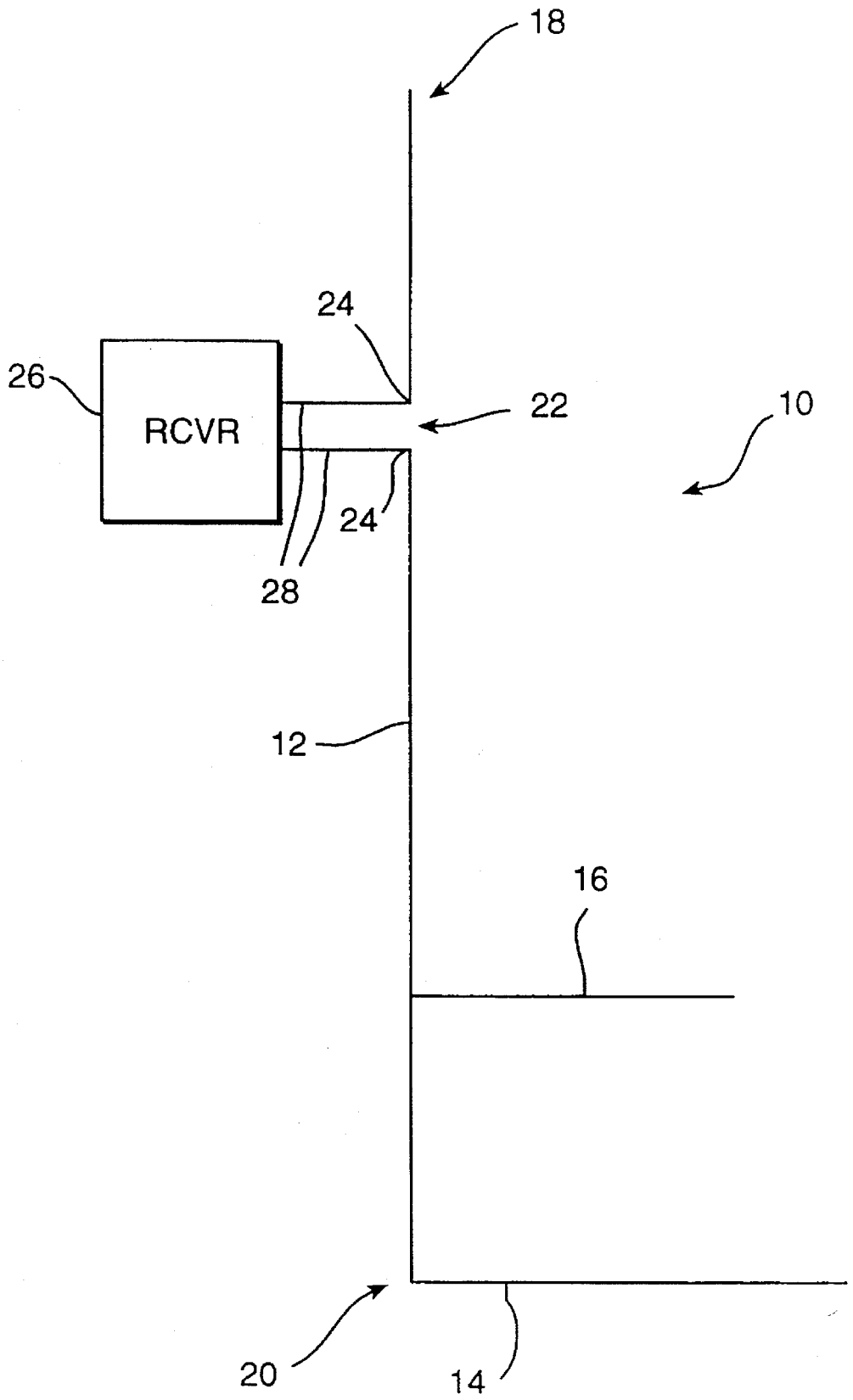
FIG. 1 is a schematic illustration of the preferred dipole antenna of the present invention.

Turning to FIG. 1, a dipole antenna 10 of the present invention comprises a primary linear element 12, a secondary linear element 14 and a tertiary linear element 16. The primary element 12 has a proximal end 18 and a distal end 20. The primary element is separated intermediate its proximal and distal ends 18, 20 to provide a breakpoint 22. Breakpoint 22 defines two feeding connections 24 by which the dipole antenna 10 may be connected to a receiving device 26.

Secondary linear element 14 is connected to the distal end 20 of the primary element 12. The secondary element 14 extends generally perpendicular from primary element 12 to form a generally "L" shape. The tertiary element 16 is then connected to primary element 12 at some point intermediate the distal end 20 and the breakpoint 22 on primary element 12. The tertiary element 16 is also connected generally perpendicular to primary element 12. Thus, antenna 10 preferably has a general "F" shape, see FIG. 3*a*.

The receiving device 26 may be any suitable receiving device since the antenna 10 is suitable for most motor vehicles applications. However, it is particularly applicable for a passive remote entry system for which it will initially be utilized. A suitable receiving device for the antenna of the present invention is disclosed in U.S. Pat. No. 4,942,393 to Waraksa et al, issuing Jul. 17, 1990, the disclosure of which is herein incorporated by reference. The receiving device may be connected in any suitable fashion by a connection means 28, such as for example a co-axial cable. For such connection, the center conductor of the co-axial cable is connected to one of the feeding connections 24 with the co-axial cable sheath being connected to the other one of the feeding connections 24.

The antenna 10 of the present invention provides several benefits and advantages, not available with the antennas of the prior art. The antenna 10 of the present invention is substantially easier to tune than those of the prior art. The primary element 12 in conjunction with the secondary element 14 comprise the overall effective length of the antenna 10. This effective length can be easily adjusted to resonate at the desired frequency.

In addition, the length of tertiary element 16 can be used to match the impedance of the antenna 10 to the receiving device 26. Impedance matching to the receiving device 26 is desirable to allow maximum power received by the antenna 10 to be delivered to the receiving device 26. This impedance matching is accomplished through adjusting the length of the tertiary element 16.

Further, the length of the tertiary element 16 may be adjusted to increase the frequency bandwidth of the antenna 10. As a result, the antenna 10 of the present invention provides much greater frequency bandwidth over which the antenna 10 will receive. It is thus a more versatile antenna than those of the prior art. In essence, the addition of the tertiary element 16 allows the single antenna 10 of the present invention to perform as two separate antennas of the prior art.

Figure 2A:
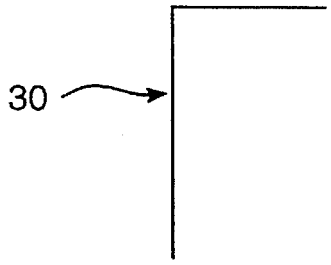
FIGS. 2*a* and 2*b* illustrate a prior art antenna and the radiation pattern for the prior art antenna.
Figure 2B:
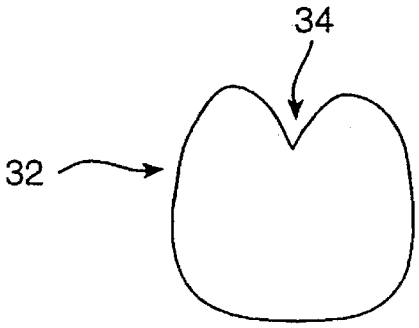

In addition to easier tunability, the dipole antenna 10 of the present invention provides a substantially smoother radiation pattern than the antenna of the prior art. FIG. 2*a* depicts a common "L" shaped antenna 30 of the prior art such as disclosed in U.S. Pat. No. 4,914,447. FIG. 2*b* depicts the radiation pattern of antenna 30 of FIG. 2*a*. The radiation pattern is essentially a pattern of the area from which an antenna may receive radio waves. As can be seen, the radiation pattern 32 has a rather large void or null 34. This void 34 will create receiving difficulties in many applications. For example, in a passive entry system, if a vehicle is approached from the area corresponding to the null 34 in the radiation pattern, the operating range of the passive entry system will be greatly reduced.

Figure 3A:
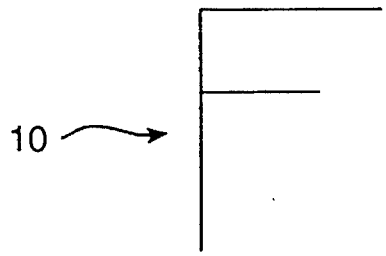
PRIOR ART FIG -3A
FIGS. 3*a* and 3*b* illustrate a vertically oriented antenna in accordance with the present invention and its radiation pattern.
Figure 3B:
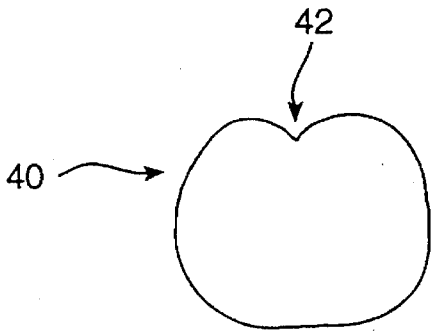
PRIOR ART FIG -3B

On the other hand, the radiation pattern of the dipole antenna 10 of the present invention provides a substantially smoother radiation pattern than the prior art. FIG. 3*a* depicts the antenna 10 of the prior art while FIG. 3*b* illustrates the radiation pattern 40 of the antenna 10 of FIG. 3*a*. As can be seen, the radiation pattern 40 is substantially smooth with only a minor null 42 present. As a result, the antenna of the present invention receives radio waves over a larger area than the antenna 30 of the prior art and is better suited for many applications such as a passive entry system for a motor vehicle.

The dipole antenna 10 of the present invention is particularly suited for motor vehicle applications. The antenna may be installed in most any motor vehicle such as automobiles, trucks, construction equipment and airplanes. Again, the antenna 10 may be adapted for most any use requiring the transmission or receiving of radio waves. However, the antenna 10 of the present invention is particularly applicable for a passive entry system in a motor vehicle.

When installed into a motor vehicle, the motor vehicle itself will define an electrical ground potential. That is, in prior art applications, the antenna itself is grounded to the motor vehicle. However, in the present invention, the antenna is electrically insulated from the motor vehicle ground potential. In other words, the antenna itself is not grounded in the present invention. Rather, the antenna is only grounded through the ground of the receiving device to which the antenna is connected.

Figure 4:
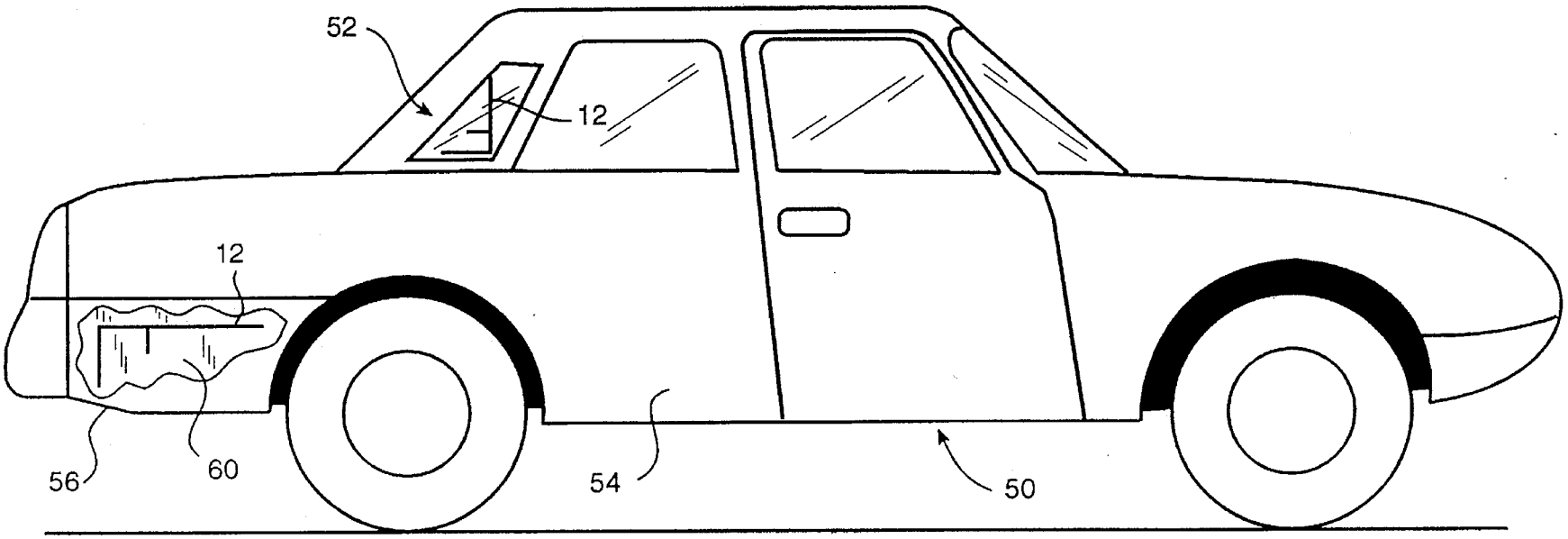
FIG. 4 illustrates deployment of the antenna of the present invention in a motor vehicle.

Turning to FIG. 4, it can be seen that the antenna 10 may be installed in various locations around the motor vehicle. FIG. 4 depicts a motor vehicle 50. The dipole antenna 10 of the present invention may be installed in either a glass portion 52 of the vehicle 50, a body portion 54 of the vehicle 50 or both locations simultaneously. The body portion 54 may comprise most any location around the body of the motor vehicle 50. Preferably, if the antenna is mounted on a side portion of the vehicle body 54, then the antenna 10 is mounted on one or both rear quarters panels 56 of the vehicle 50. In this manner, the fender trim strip on the rear quarter panel functions as a Radome shield protecting the antenna 10 from environmental hazards.

When employing the antenna 10 of the present invention in a body portion of the motor vehicle 50, at least some portion of the vehicle 50 may be maintained at a ground potential to thereby define a ground plane. In other words, at least some portion of the vehicle is employed as a ground for the receiving device 26. This portion then defines a ground plane 60 for the receiving system. The antenna 10 of the present invention may then be closely spaced to the ground plane 60. By closely spaced, it is intended to mean that the antenna 10 of the present invention is spaced about 1/25th of a wavelength or less from the ground plane 60.

By closely spacing the antenna 10 to the ground plane 60, several unique advantages are gained over antennas of the prior art. By such close spacing, the antenna 10 of the present invention can be operated as a directional antenna rather than a omni-directional antenna. That is, the ground plane 60 functions to isolate the antenna 10 from radio waves approaching the antenna 10 from the opposite direction. Thus, the antenna 10 will receive radio waves from only one general direction. For example, if the ground plane 60 is chosen as a rear quarter panel, then the antenna 10 will receive radio waves from only one side of the vehicle 50. In this fashion, with an antenna on each side of the vehicle 50, a passive entry system can determine from which direction a user is approaching the vehicle 50 and unlock the doors accordingly.

The antenna 10 of the present invention further provides significant front-to-back separation ratio. The front-to-back ratio for the antenna 10 of the present invention is in excess of 10 db. Thus, the antenna 10 has not sacrificed the strength by which radio signals may be received by being closely spaced to the ground plane 60 on the vehicle 50. Accordingly, the receiving device 26 circuits are significantly easier to manufacture than those of the prior art.

Further, the antenna 10 of the present invention provides for simple adjustment of the Voltage Standing Wave Ratio or VSWR. VSWR may be simply and efficiently adjusting by varying the separation distance between the antenna 10 and the ground plane 60. When employing the antenna 10 of the present invention as a directional antenna closely spaced to the ground plane 60, the antenna 10 is preferably oriented with primary element 12 being substantially horizontal, as shown in the rear quarter panel 56 of the vehicle 50 of FIG. 4.

However, the antenna 10 of the present invention may be employed as a omni-directional antenna. By mounting the antenna 10 spaced apart from a ground plane, such as in a glass portion of the vehicle 50, the antenna 10 of the present invention may receive radio waves from all directions. When employed as a omni-directional antenna, the antenna 10 of the present invention is oriented so that the primary element 12 is substantially vertical as shown in the opera window of the vehicle 50 of FIG. 4. More preferably, if employed as a omni-directional antenna, the antenna 10 of the present invention is oriented with primary element 12 vertical and the distal end 20 inverted as also shown in the opera window of the vehicle 50 of FIG. 4.

Accordingly, the antenna 10 of the present invention provides numerous advantages over those of the prior art. The antenna 10 may be easily and efficiently tuned by adjusting the length and separation of the elements. The antenna 10 of the present invention provides for increased bandwidth and easier impedance matching than prior art antennas. The antenna 10 also provides for a substantially smooth radiation pattern and may be used as either a omni-directional or directional antenna.

Having described the invention in detail and by reference to the preferred embodiments thereof, it will be apparent that modifications and variation are possible without departing from the scope of the invention which is defined in the appended claims.

What is claimed is:

1. An F-shaped three element dipole antenna for incorporation into a portion of a motor vehicle, said dipole antenna comprising:

a primary linear element having a proximal end and a distal end, said primary linear element being separated intermediate its proximal and distal ends at a breakpoint to define two feeding connections to said dipole antenna;

a secondary linear element connected to the distal end of said primary linear element and extending generally perpendicular to said primary linear element; and a tertiary linear element connected to said primary linear element intermediate the distal end of said primary linear element and said breakpoint, said tertiary linear element extending generally perpendicular to said primary linear element.

2. An F-shaped three element dipole antenna as claimed in claim 1 wherein said motor vehicle defines an electrical ground potential and said dipole antenna is electrically insulated from said motor vehicle ground potential.

3. An F-shaped three element dipole antenna as claimed in claim 2 wherein at least some portion of said vehicle is maintained at said motor vehicle ground potential to thereby define a ground plane and said dipole antenna is closely spaced from said ground plane.

4. An F-shaped three element dipole antenna as claimed in claim 3 wherein said dipole antenna is spaced about 1/25th or less of a wavelength from said ground plane.

5. An F-shaped three element dipole antenna as claimed in claim 3 wherein said ground plane comprises at least a portion of a side of said motor vehicle, said dipole antenna being mounted on said at least a portion of a side of said motor vehicle to thereby make said dipole antenna directive from said side of said motor vehicle.

6. An F-shaped three element dipole antenna as claimed in claim 5 wherein said at least a portion of a side of said motor vehicle comprises a rear quarter panel of said motor vehicle.

7. A method of making an F-shaped three element dipole antenna for a motor vehicle comprising the steps of:

providing a primary linear antenna element having a proximal end and a distal end;

separating said primary linear antenna element intermediate its proximal and distal ends to define two feeding connections to said dipole antenna;

connecting a secondary linear antenna element to the distal end of said primary linear element to extend generally perpendicular to said primary linear element; and connecting a tertiary linear antenna element to said primary linear antenna element intermediate the distal end of said primary linear antenna element and said two feeding connections, said tertiary linear antenna element extending generally perpendicular to said primary linear element.

8. A method of making an F-shaped three element dipole antenna for a motor vehicle as claimed in claim 7 further comprising the step of selecting the combined length of said primary linear antenna element and said secondary linear antenna element to select a desired resonant frequency for said dipole antenna.

9. A method of making an F-shaped three element dipole antenna for a motor vehicle as claimed in claim 8 further comprising the step of selecting the spacing between said secondary and tertiary linear antenna elements to smooth nulling of an antenna pattern of said dipole antenna.

10. A method of making an F-shaped three element dipole antenna for a motor vehicle as claimed in claim 9 further comprising the step of selecting the length of said tertiary antenna element to increase the impedance bandwidth of said dipole antenna.

11. A method of making an F-shaped three element dipole antenna for a motor vehicle as claimed in claim 7 wherein at least a portion of said motor vehicle defines a ground plane, said method further comprising the steps of:

mounting said dipole antenna over a ground plane defined by said motor vehicle; and insulating said dipole antenna from said ground plane.

12. A method of making an F-shaped three element dipole antenna for a motor vehicle as claimed in claim 11 further comprising the step of selecting the spacing of said dipole antenna from said ground plane to adjust the voltage standing wave ratio of said dipole antenna.

13. A method of making an F-shaped three element dipole antenna for a motor vehicle as claimed in claim 11 further comprising the step of selecting the portion of said motor vehicle defining a ground plane to be on a side of said motor vehicle to thereby make said dipole antenna directive from said side of said motor vehicle.

14. A method of making an F-shaped three element dipole antenna for a motor vehicle as claimed in claim 13 further comprising the step of selecting the portion of said motor vehicle defining a ground plane to be a rear quarter panel of said motor vehicle.

15. An antenna system for passive entry systems in motor vehicles comprising:

an F-shaped three element dipole antenna, said dipole antenna comprising a) a primary linear element having a proximal end and a distal end, said primary linear element being separated intermediate its proximal and distal ends at a breakpoint to define two feeding connections to said dipole antenna;

b) a secondary linear element connected to the distal end of said primary linear element and extending generally perpendicular to said primary linear element; and c) a tertiary linear element connected to said primary linear element intermediate the distal end of said primary linear element and said breakpoint, said tertiary linear element extending generally perpendicular to said primary linear element;

a receiving device for receiving radio signals inputted to said antenna.

16. An antenna system as claimed in claim 15 wherein said motor vehicle defines an electrical ground potential and said dipole antenna is electrically insulated from said motor vehicle ground potential.

17. An antenna system as claimed in claim 16 wherein at least some portion of said vehicle is maintained at said motor vehicle ground potential to thereby define a ground plane, said receiving device is electrically grounded to said ground plane and said dipole antenna is closely spaced from said ground plane.

18. An antenna system as claimed in claim 17 wherein said dipole antenna is spaced about 1/25th or less of a wavelength from said ground plane.

19. An antenna system as claimed in claim 15 wherein said primary linear element is horizontally oriented in said motor vehicle.

20. An antenna system as claimed in claim 15 wherein said primary linear element is vertically oriented.

* * * * *